United States Patent [19]

Ho

[11] 3,964,252

[45] June 22, 1976

[54] ADJUSTABLE HINGE BAND

[75] Inventor: Kok-Kit Ho, Kowloon, Hong Kong

[73] Assignee: Timex Corporation, Waterbury, Conn.

[22] Filed: Sept. 4, 1975

[21] Appl. No.: 610,467

[52] U.S. Cl. ..... 59/80; 59/91

[51] Int. Cl.[2] ..... F16G 13/18

[58] Field of Search ..... 59/78, 80, 82, 85, 91; 63/4; 224/4 D

[56] References Cited

UNITED STATES PATENTS

| | | | |
|---|---|---|---|
| 1,784,451 | 12/1930 | Kraemer | 59/80 |
| 1,822,393 | 9/1931 | Fassnacht | 59/80 |
| 2,442,546 | 6/1948 | Lipschitz | 224/4 |
| 2,505,169 | 4/1950 | Bikoff | 59/80 |
| 3,857,237 | 12/1974 | Brauchi | 59/80 |

FOREIGN PATENTS OR APPLICATIONS

| | | | |
|---|---|---|---|
| 1,128,696 | 4/1962 | Germany | 59/80 |

*Primary Examiner*—C. W. Lanham
*Assistant Examiner*—Gene P. Crosby

[57] ABSTRACT

A hinge band with decorative links articulated about pivot pins includes a plurality of special removable links in order to adjust the length of the hinge band, for example, to fit the arm of the wearer where the hinge band holds a wristwatch or the like. The removable links have decorative insert members and partial collars. Selected links may be released by pivoting and depressing the spring retainers which hold the pins in blocking relation in the partial collars.

7 Claims, 6 Drawing Figures

ADJUSTABLE HINGE BAND

BACKGROUND OF THE INVENTION

This invention relates generally to hinge bands or articulated link bracelets for holding wristwatches and the like. More particularly, the invention relates to a hinge band with improved means to adjust the length of the bracelet through the use of special removable links.

Decorative hinge bands with box-shaped articulated links which pivot about nested coaxial collars on pivot pins are known in the art. Examples of such bracelets are seen in U.S. Pat. 1,822,393 issued Sept. 8, 1931 to Fassnacht et al and in Swiss Pat. No. 392,958 published 15 October 1965 in the name of Henri Nobs. Decorative links for such hinge bands are also known as seen, for example, in Italian design Pat. No. 148,365, and other known prior art bracelets, wherein inserts of various design or color may be exposed through openings of various shapes and sizes in the links for decorative purposes.

Constructions have also been known in the art which employ resilient members for the purpose of facilitating removal of links. For example see U.S. Pat. 1,784,451 issued Dec. 9, 1930 to Kraemer and U.S. Pat. 3,857,237 issued Dec. 31, 1974 to Brauchi, the latter involving a rather complicated construction with a removable retaining spring. It is desired to have an improved construction for an adjustable hinge band which includes simplified and economical means for addition or removal of selected links from the band. The removal feature should not interfere with the decorative aspect of the bracelet.

Accordingly, one object of the present invention is to provide an improved construction for a hinge band which allows addition or removal of selected links from the band to adjust the length.

Another object of the invention is to provide an improved construction for a decorative and removable link in an articulated hinge band.

DRAWING

The invention will best be understood by reference to the following description, taken in connection with the accompanying drawings, in which.

SUMMARY OF THE INVENTION

Briefly stated the invention comprises an improvement in an hinge band of the type having a plurality of links connected by pins, the links each comprising a top plate with opposite sides folded to provide nesting coaxial collars for holding the pins and with opposite ends folded to provide a box structure. The improvement comprises the provision of a plurality of removable links, each having partially closed collars on one side to permit disengagement of the pin when the link is pivoted and including springs biasing the pins into the partially closed collars. The springs may be incorporated into decorative insert members held in the box structure.

DESCRIPTION

Figure 1:
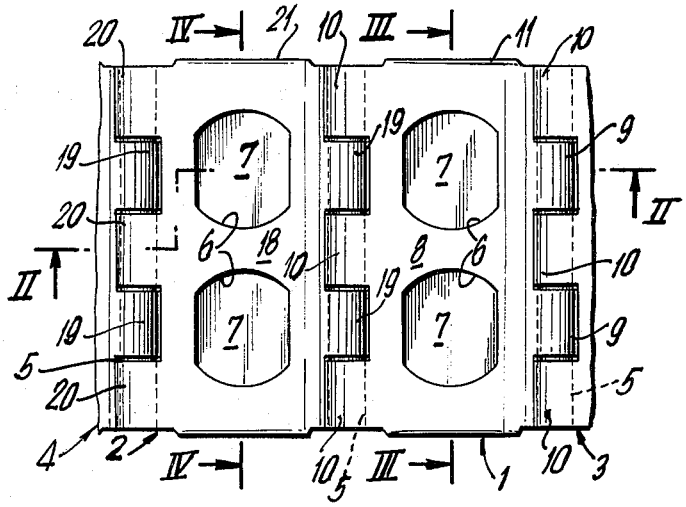
FIG. 1 is a plan view showing a section of the hinge band.
Figure 2:
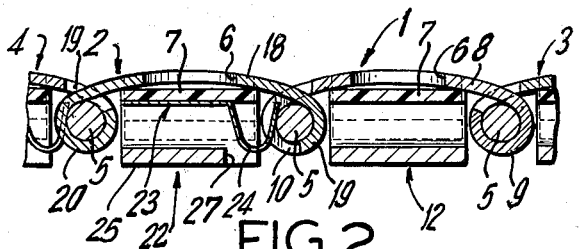
FIGS. 2, 3 and 4 are cross sectional views taken respectively along lines II — II, III — III and IV — IV of the drawing.
Figure 5:
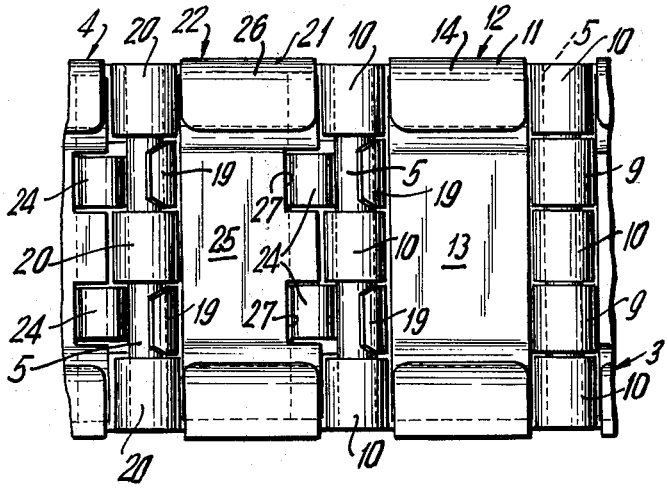
FIG. 5 is a bottom view of a section of the hinge band.

Referring now to FIGS. 1, 2 and 5 of the drawing, a portion of a hinge band or link bracelet comprises a series of interconnected links. The links are of two types, normal links 1 and removable links 2. A portion of an adjacent connected normal link 3 is seen on the right hand side of FIG. 1 and a portion of a removable link 4 is seen on the left hand side of FIG. 1. Links 1–4 and others like them together make up a band which may be fitted with a clasp and, if the band is to be used for a wristwatch or the like may also be fitted with terminating attachment members (not shown) adapted to hold a spring bar or otherwise adapted for connection to a watch.

The links are constructed in a manner to be described so that they can be connected to one another by cylindrical pins 5 and also to permit articulation or pivoting about the pins. Also in the preferred embodiment, links 1–4 each appear identical to one another from the top and preferably include cutouts for openings 6 of various shapes, i.e. circular, elliptical, homboid, diamond, star etc. so as to expose decorative inserted sheets of colored plastic or the like.

First the construction of a normal link 1 will be described, particularly by reference to the cross sectional views of FIGS. 2 and 3. Link 1 comprises a top plate member 8 cut to provide decorative openings 6 and to provide alternative tabs, 9 on one side and 10 on the other side, which are folded around to form loops or collars. In the case of connections between normal links 1, 3, adjacent collars 9, 10 nest with one another so that they are coaxial and pins 5 fit in the coaxial openings to provide pivoting or hinge action. To prevent the pins from coming out, the collars 10 may be made so as to fit the pins tightly with pivoting taking place about the pins by collars 9, in the manner of the aforementioned Swiss Pat. No. 392,958. Alternatively, the ends of the pins may be upset, or the opposite ends of the links may be folded over the ends of the pins as in the aforementioned U.S. Pat. No. 1,822,393.

Figure 3:
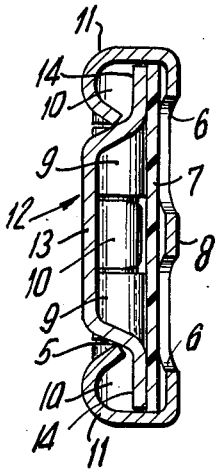

As seen most clearly in FIG. 3, the opposite ends of a plate 8 are also provided with end tabs 11 which are folded over to shape the link into a box-like structure. The folded over end tabs both serve to close off the opposite ends of the link to give it a solid appearance as well as to hold in place a decorative insert member 12. Insert member 12 comprises a metal back plate 13 with opposite holding flanges 14 supporting the ends of a plastic decorative sheet 7. The insert member 12 with the sheet 7 is firmly held in place against the underside of top plate 8 by the opposite end tabs 11 of the top plate.

The aforementioned link construction is known in the art. In order to adjust the length of the hinge band to fit the arm of the wearer, links must be added or removed by removing pins 5 which can be a difficult and time consuming operation.

The improved hinge band contains a plurality of removable links 2, 4. Referring to the cross sectional views in FIGS. 2 and 4, top plate members 18 have opposite alternating side tabs 19, 20. Tabs 20 are folded around to form almost fully closed collars as before, in the manner of collars 9, 10. However collars 19 only form partial collars or loops. The end collars 20 are fully formed so that they may hold pins 5 in place.

The opposite ends 21 of the links are folded over as before to form a box structure holding insert members 22 in place.

In accordance with the present invention, the insert members 22 incorporate a leaf spring retainer 23 with resilient spring tabs 24 disposed opposite the partial collars 19 so as to hold pins 5 against the collars 19. The partial collars 19 are arranged to curve around and terminate on the lower half of pins 5 which, when aided by spring tabs 24, will keep the removable links from falling off.

Figure 4:
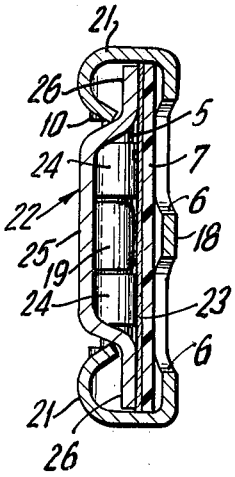

Reference to the cross section of FIG. 4 shows the construction of the insert member 22 of a removable link to differ only slightly from insert member 12 of a normal link. The back plate 25 has opposite holding flanges 26 which are slightly shallower than before, in order to accommodate the added thickness of the leaf spring retainer plate 23 between them and the colored plastic insert 7.

Referring to FIGS. 2 and the backview of FIG. 5 of the drawing, shows that the retainer plate 25 is also notched at 27 to provide clearance for the spring tabs 24. The backview of FIG. 5 further shows the details of construction.

OPERATION

As will be seen in FIG. 2 of the drawing, when the band is substantially flat or when the links are not pivoted at an excessive angle, the insert members 12, 22 prevent pins 5 from coming out of the partial collars 19. This is because the insert members do not provide clearance for the collars 19, 20 to move very far sideways without striking the insert members. Also tabs 24 hold the pins in place. During normal handling of the hinge band, even when one link pivots at an excessive angle with respect to the other, the spring tabs 24 press the pins 5 into the partial collars 19 and prevent disengagement.

Figure 6:
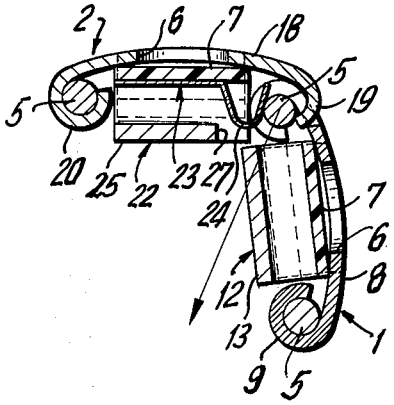
FIG. 6 is a cross sectional view of two links showing the method of operation.

Referring to FIG. 6 of the drawing, however, it is seen that when one intentionally means to remove (or add) one of the removable links such as 2, the adjacent link 3 is pivoted and the pin 5 may be pulled out of its partial collar 19 by depressing the spring tab 24 and removing the link in the direction of the arrow. At this angle the collar 19 does not interfere with the insert member 12. Of course the link on the other side of link 2 (not shown) must be constructed similar to link 2 or else adapted to receive the pin 5.

Thus a construction has been shown which permits easy adjustment of the length of a decorative hinge band by use of selectively removable links of economical construction and having an overall appearance from the outside the same as that of normal links. Other modifications will occur to those skilled in the art and it is desired to secure in the appended claims all such modifications as fall within the true spirit and scope of the invention.

I claim:

1. In a hinge band for a wristwatch or the like, of the type comprising a plurality of links connected by pins, said links having a top plate with opposite sides folded over to provide nesting coaxial collars for holding said pins and also with opposite ends folded to provide a box structure, said hinge band having a plurality of improved removable links, wherein the improvement comprises:

said collars on one side of each of said removable links being only partially closed to permit disengagement of the pin when the link is pivoted, and spring means biasing said pins into said partial collars.

2. The combination according to claim 1 wherein said spring means comprises a plurality of leaf spring tabs each disposed opposite one of said partial collars.

3. The combination according to claim 1, wherein said top plate box structure holds insert members which are adapted to interfere with substantial sideways movement of said collars when the band is substantially flat, so as to prevent disengagement of said pins unless the links are pivoted.

4. The combination according to claim 1 wherein said partial collars curve around and terminate on the lower half of said pins.

5. The combination according to claim 1 wherein said top plate box structure holds an insert member, the insert members in said removable links further incorporating said spring means.

6. The combination according to claim 5, wherein said spring means comprises a flat member having spring tabs thereon, retained in place by the opposite ends of said top plate.

7. The combination according to claim 5, wherein the insert member comprises a retainer back plate holding the leaf spring member and a decorative sheet inside said box structure.

* * * * *